US010206509B1

(12) United States Patent
Liao

(10) Patent No.: US 10,206,509 B1
(45) Date of Patent: Feb. 19, 2019

(54) RAPID FIXING STRUCTURE FOR HEIGHT ADJUSTING ROD OF MUSICAL INSTRUMENT CHAIR

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 15/808,634

(22) Filed: Nov. 9, 2017

(51) Int. Cl.
*A47C 3/40* (2006.01)
*A47C 9/08* (2006.01)

(52) U.S. Cl.
CPC . *A47C 3/40* (2013.01); *A47C 9/08* (2013.01)

(58) Field of Classification Search
CPC ..... A47C 3/40; A47C 9/08
USPC ..... 248/408, 161, 409, 410; 297/344.12
See application file for complete search history.

(56) References Cited

U.S. PATENT DOCUMENTS 2,659,413 A * 11/1953 Cramer ..... A47C 3/34 248/408
2,909,212 A * 10/1959 Scherer ..... A47C 3/026 248/408
3,770,236 A * 11/1973 Marsh ..... A47C 3/34 248/408
4,318,526 A * 3/1982 Werner ..... A47C 3/40 248/412
4,867,406 A * 9/1989 Lengacher ..... A47C 3/26 248/125.2
5,842,742 A * 12/1998 Hoshino ..... A47C 9/08 297/338
5,927,810 A 7/1999 Liao
2011/0239913 A1* 10/2011 Chung ..... B25H 1/18 108/146

* cited by examiner

*Primary Examiner* — Anita M King
(74) *Attorney, Agent, or Firm* — Muncy, Geissler, Olds & Lowe, P.C.

(57) ABSTRACT

The present invention aims to adjust the height of a musical instrument chair, including an upright rod seat, a pressing plate, a return spring, and an upright rod, wherein the upright rod seat comprises an up-to-down through receiving space and a side opening horizontally communicated with the receiving space; the pressing plate is disposed at the side opening and pivoted to the upright rod seat; the return spring is disposed between the pressing plate and the upright rod seat; and the musical instrument chair is disposed at an upper end of the upright rod, and the upright rod penetrates into the receiving space from up to down, and is provided with a plurality of height-different fastening slots in which the pressing plate is fastened at the normal position so as to fix the upright rod.

9 Claims, 7 Drawing Sheets

RAPID FIXING STRUCTURE FOR HEIGHT ADJUSTING ROD OF MUSICAL INSTRUMENT CHAIR

FIELD OF THE INVENTION

The present invention relates to a height adjusting rod of a musical instrument chair, and more particularly to a rapid fixing structure for a height adjusting rod of a musical instrument chair.

BACKGROUND OF THE INVENTION

Referring to FIG. 1 and FIG. 2, a conventional height adjusting mechanism of a musical instrument chair includes a stand 1. The stand 1 is provided with a central rod 2, a connecting head 3, a screw rod 4, a chair cushion 5 and a fixing ring 6. The fixing ring 6 is in a hollow ring shape, where the interior of an upper segment of the fixing ring is a reducing segment 7, and threads are disposed therein and screwed with the screw rod 4. The interior of a lower segment of the fixing ring 6 is an expanding segment 8, which sleeves a top end of the connecting head 3 and is pressed against an edge face of the connecting head 3 by a radial-penetrating pressing screw 9 so as to fix the fixing ring 6. When the height is adjusted, the pressing screw 9 is unlocked, and then the height of the chair cushion 5 is adjusted in a manner of rotating the screw rod 4. However, the screwing adjustment manner is slow, and cannot meet demands for use.

Also as shown in U.S. Pat. No. 5,927,810, an adjusting rod fixing structure of a musical instrument chair is disclosed. A screw rod can be maintained at a fixed height without shaking, and can be finely adjusted in a stepless manner. However, the structure is complicated and the assembly cost is high; moreover, the screw rod is still fixed in a screwing manner; in case of excessively screwing it down, a weak user cannot make it loosened; and in case of not screwing it down, a danger may be caused due to unexpected loosening.

SUMMARY OF THE INVENTION

In view of this, a main objective of the present invention is to make a user adjust the screw chair height of a musical instrument chair rapidly with less effort, thereby meeting demands for use.

To this end, the present invention includes an upright rod seat, a pressing plate, a return spring and an upright rod, wherein the upright rod seat is provided with an up-to-down through receiving space and a side opening horizontally communicated with the receiving space; the pressing plate is disposed at the side opening and pivoted to the upright rod seat, and possesses a normal position invading the receiving space and an instant position exiting from the receiving space; the return spring is disposed between the pressing plate and the upright rod seat, and pushes the pressing plate to be at the normal position under a normal state; and the musical instrument chair is disposed at an upper end of the upright rod, and the upright rod penetrates into the receiving space from up to down, and is provided with a plurality of height-different fastening slots in which the pressing plate is fastened at the normal position so as to fix the upright rod.

Accordingly, a user can make the pressing plate located at the instant position by utilizing a manner of pressing the pressing plate, and the pressing plate cannot be fastened by the plurality of fastening slots. Therefore, the set height of the upright rod can be changed by the user at will. That is, the height of the musical instrument chair is changed. When the pressing plate is released, the pressing plate will return to the normal position and will be re-fastened by the plurality of fastening slots so as to fix the upright rod. That is to say, the height of the musical instrument chair can be fixed for sitting.

DETAILED DESCRIPTION OF THE PREFERRED EMBODIMENTS

The technical contents, features and functions of the present invention will be clearly presented in the following description of preferable embodiments with reference to the drawings.

Figure 1:
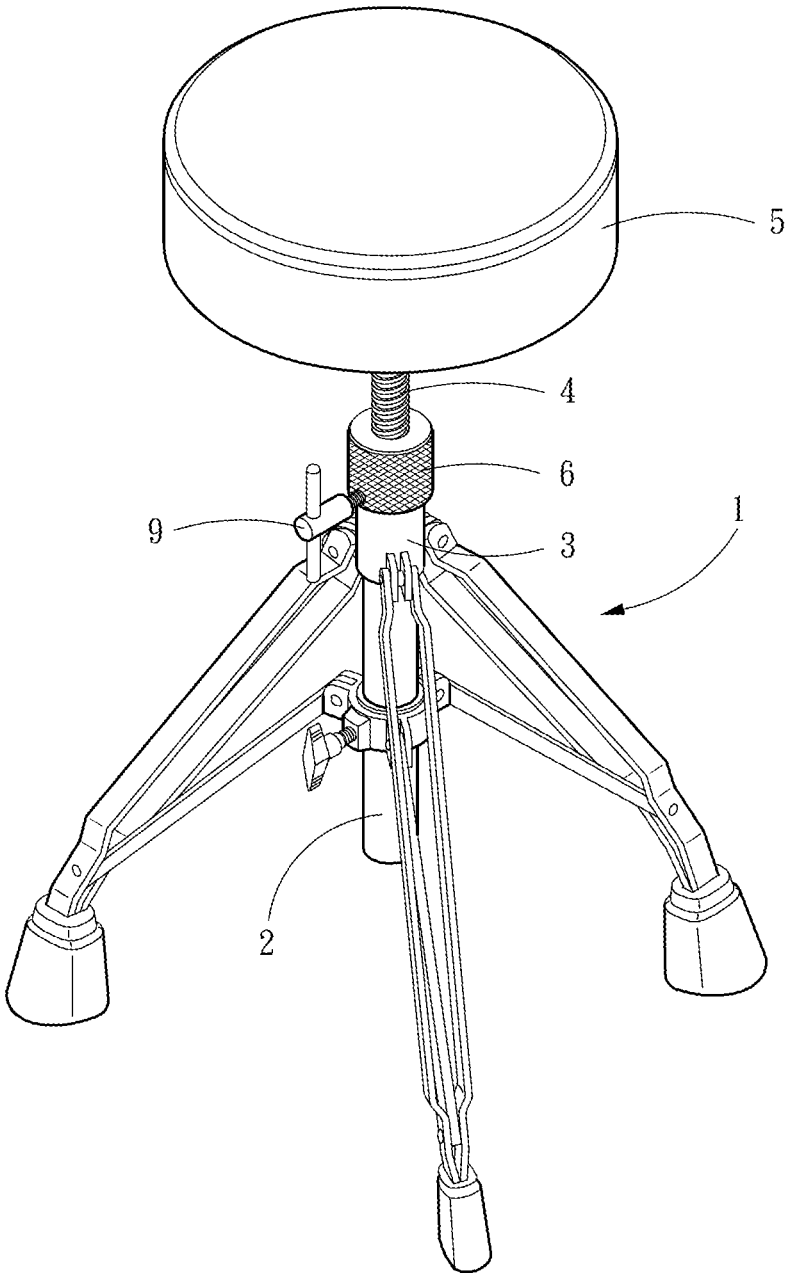
Fig. 1 PRIOR ART
FIG. 1 is a structural diagram of a conventional musical instrument chair.
Figure 2:
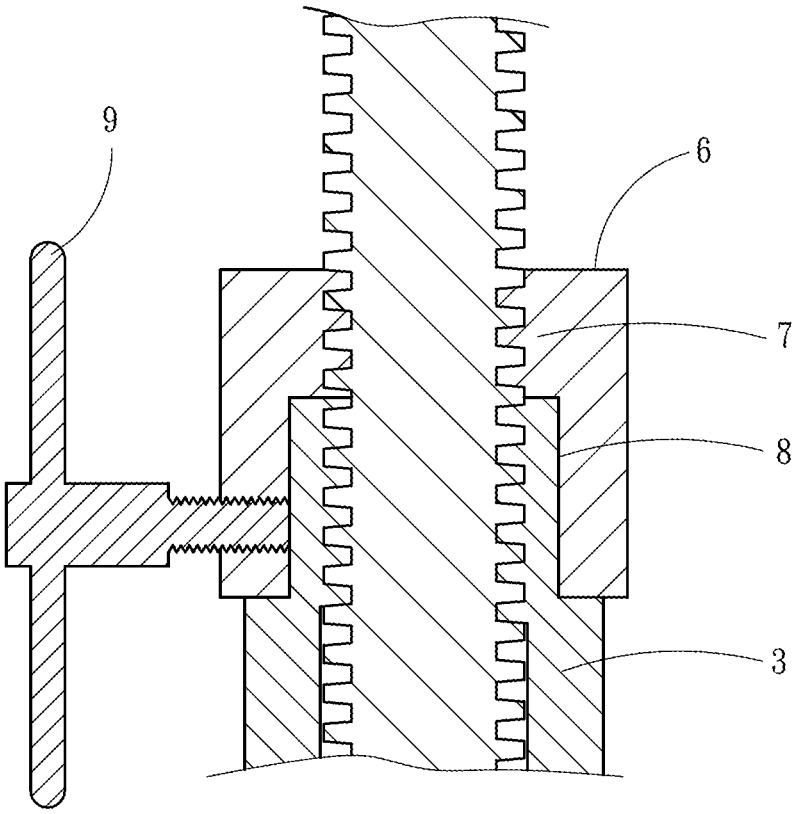
Fig . 2 PRIOR ART
FIG. 2 is a structural diagram of height adjustment of the conventional musical instrument chair.
Figure 3:
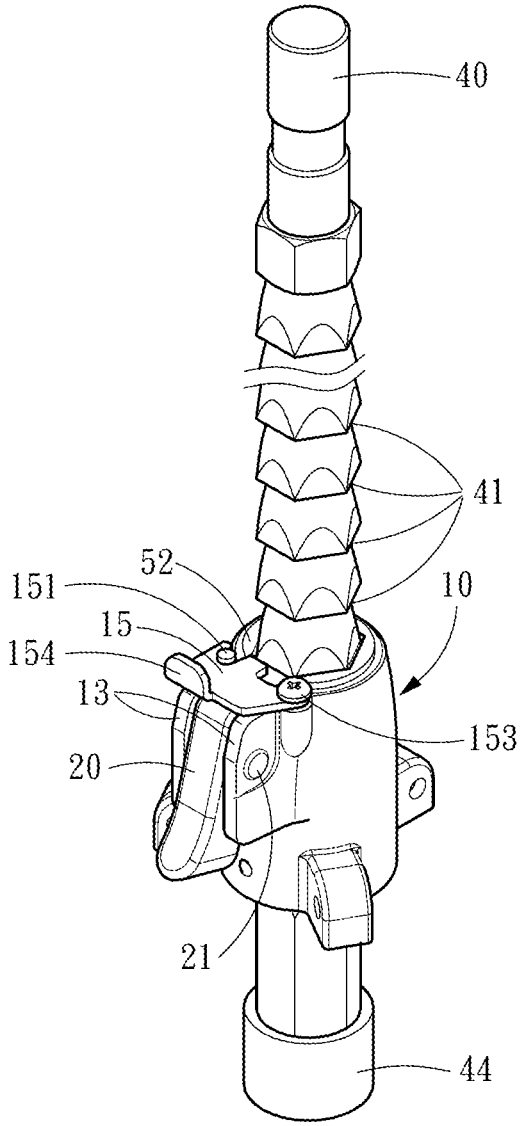
FIG. 3 is a structural diagram of an adjusting rod of the present invention.
Figure 4:
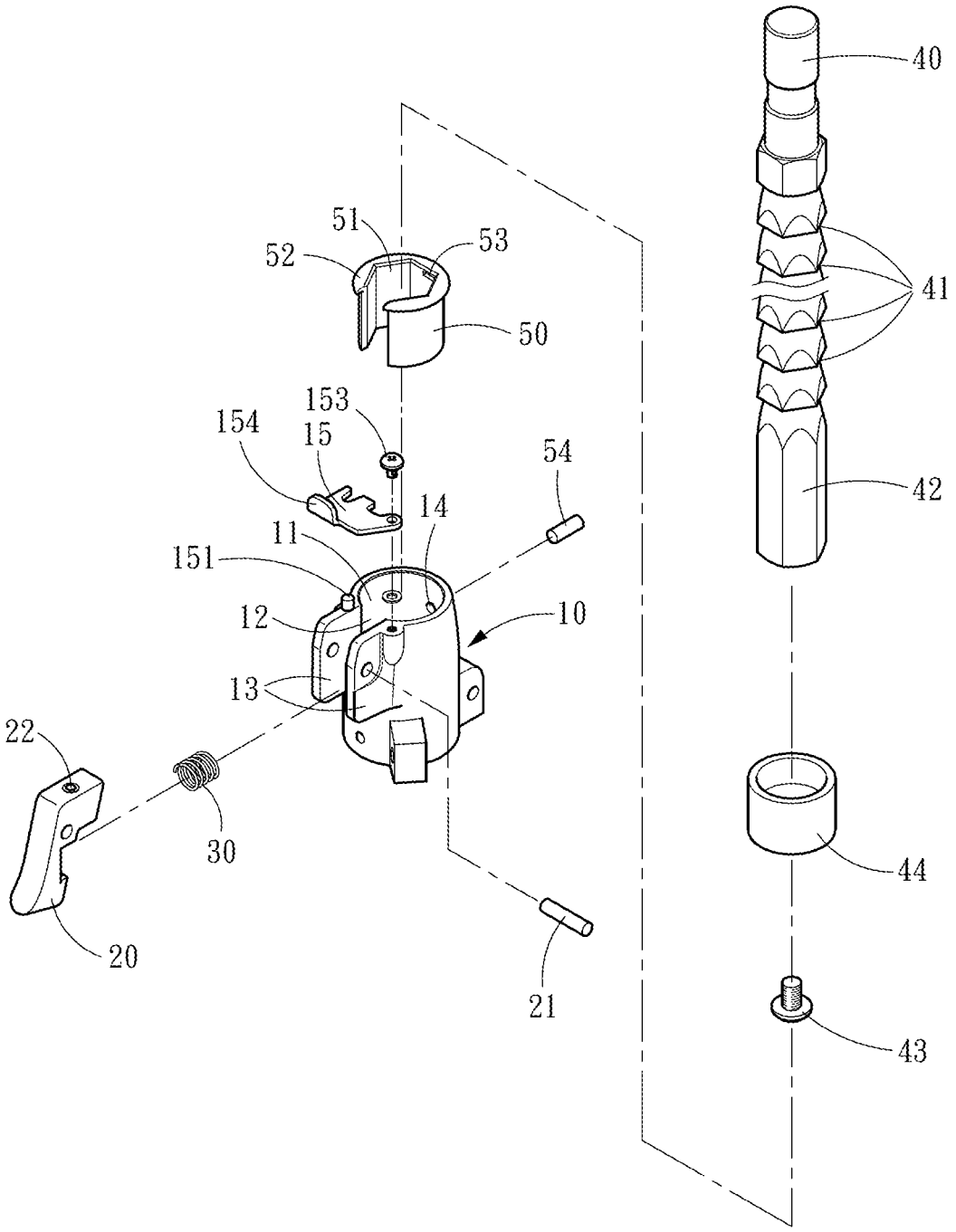
FIG. 4 is a structural exploded view of the adjusting rod of the present invention.
Figure 5:
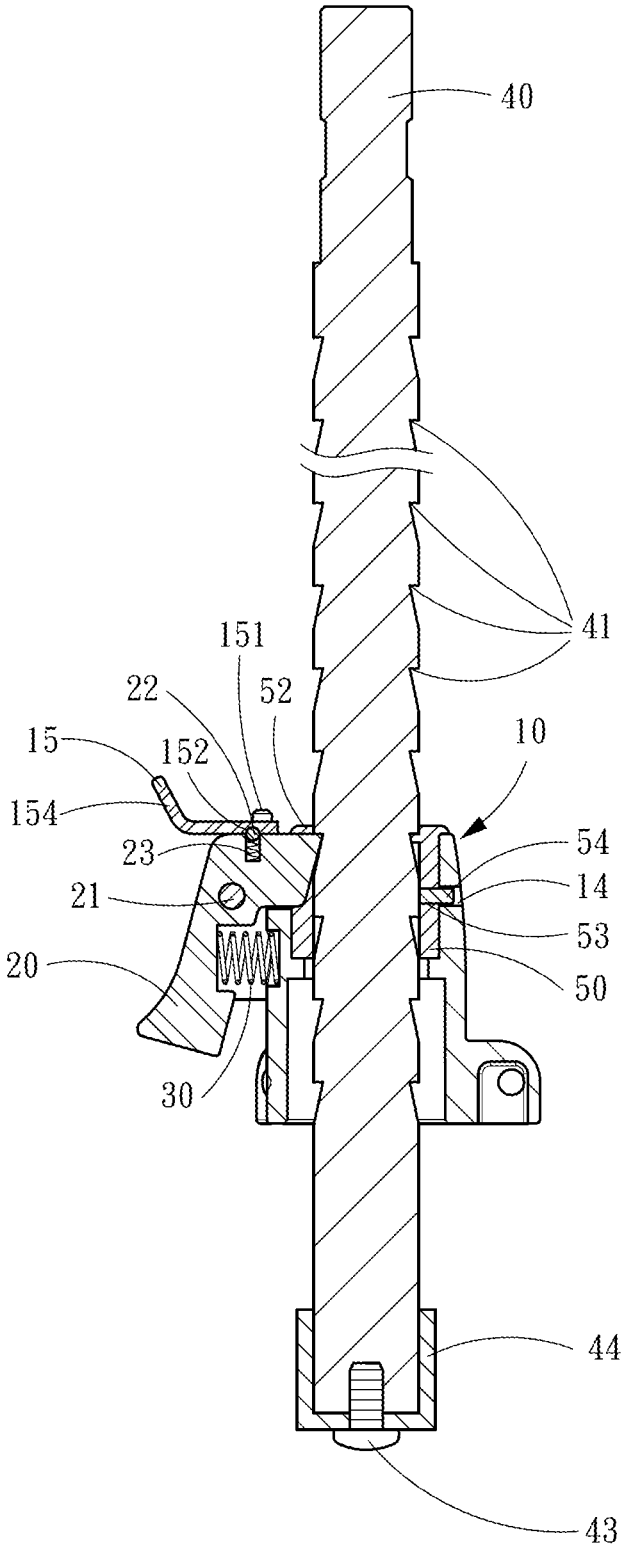
FIG. 5 is a structural sectional view of the present invention.

Referring to FIG. 3, FIG. 4 and FIG. 5, the present invention provides a rapid fixing structure for a height adjusting rod of a musical instrument chair, including an upright rod seat 10, a pressing plate 20, a return spring 30 and an upright rod 40, wherein the upright rod seat 10 is provided with an up-to-down through receiving space 11 and a side opening 12 horizontally communicated with the receiving space 11. The pressing plate 20 is disposed at the side opening 12 and pivoted to the upright rod seat 10. During practical implementation, two opposite side plates 13 extend out from the side opening 12 of the upright rod seat 10, and the pressing plate 20 is pivoted to the two side plates 13 through a pivot shaft 21. Moreover, the pressing plate 20 possesses a normal position invading the receiving space 11 and an instant position exiting from the receiving space 11.

The return spring 30 is disposed between the pressing plate 20 and the upright rod seat 10, and pushes the pressing plate 20 to be at the normal position under a normal state, and parts, in contact with the upright rod seat 10 and the side opening 12, of the return spring 30 are located on two sides of a pivot point between the pressing plate 20 and the upright rod seat 10 respectively, so as to make the return spring 30 push the pressing plate 20 to be at the normal position by utilizing a see-saw principle.

A safe latch 15 can be pivoted to an adjacent side of the side opening 12 of the upright rod seat 10. The safe latch 15 can be pivoted to the upright rod seat 10 through a bolt 153 and can be provided with a poking plate 154. The safe latch 15 rotates with respect to the upright rod seat 10 so as to possess a buckling position pressing the pressing plate 20 to be at the normal position and a separating position separated from the pressing plate 20, and in order to locate and fix the safe latch 15, the upright rod seat 10 can be provided with a locating column 151. When the safe latch 15 is at the buckling position, the locating column 151 is buckled. The upright rod seat 10 can be provided with a locating hole 152, the pressing plate 20 is provided with a locating steel bead 22 and a spring 23, corresponding to the locating hole 152, and the spring 23 will push the locating steel bead 22 to slightly protrude out of the surface of the pressing plate 20, so as to make the locating steel bead 22 fastened into the locating hole 152, thereby fixing the safe latch 15.

The upright rod 40 penetrates into the receiving space 11 from up to down, and is provided with a plurality of height-different fastening slots 41 in which the pressing plate 20 is fastened at the normal position so as to fix the upright rod 40. In order to fix the upright rod 40 to avoid rotation of the upright rod 40, the upright rod 40 can comprise an unrounded axial profile 42. The receiving space 11 is further provided with a C-shaped sleeve ring 50, wherein the C-shaped sleeve ring 50 comprises an inner profile 51 corresponding to the unrounded axial profile 42, the C-shaped sleeve ring 50 can be provided with a horizontal flange 52 propping against the exterior of the upright rod seat 10, and the C-shaped sleeve ring 50 can be provided with a sleeve ring locating hole 53. The upright rod seat 10 is provided with a rod seat locating hole 14 corresponding to the sleeve ring locating hole 53. A plug pin 54 penetrates through the sleeve ring locating hole 53 and the rod seat locating hole 14 at the same time, so that a relative position between the sleeve ring locating hole 53 and the rod seat locating hole 14 is fixed.

Figure 6:
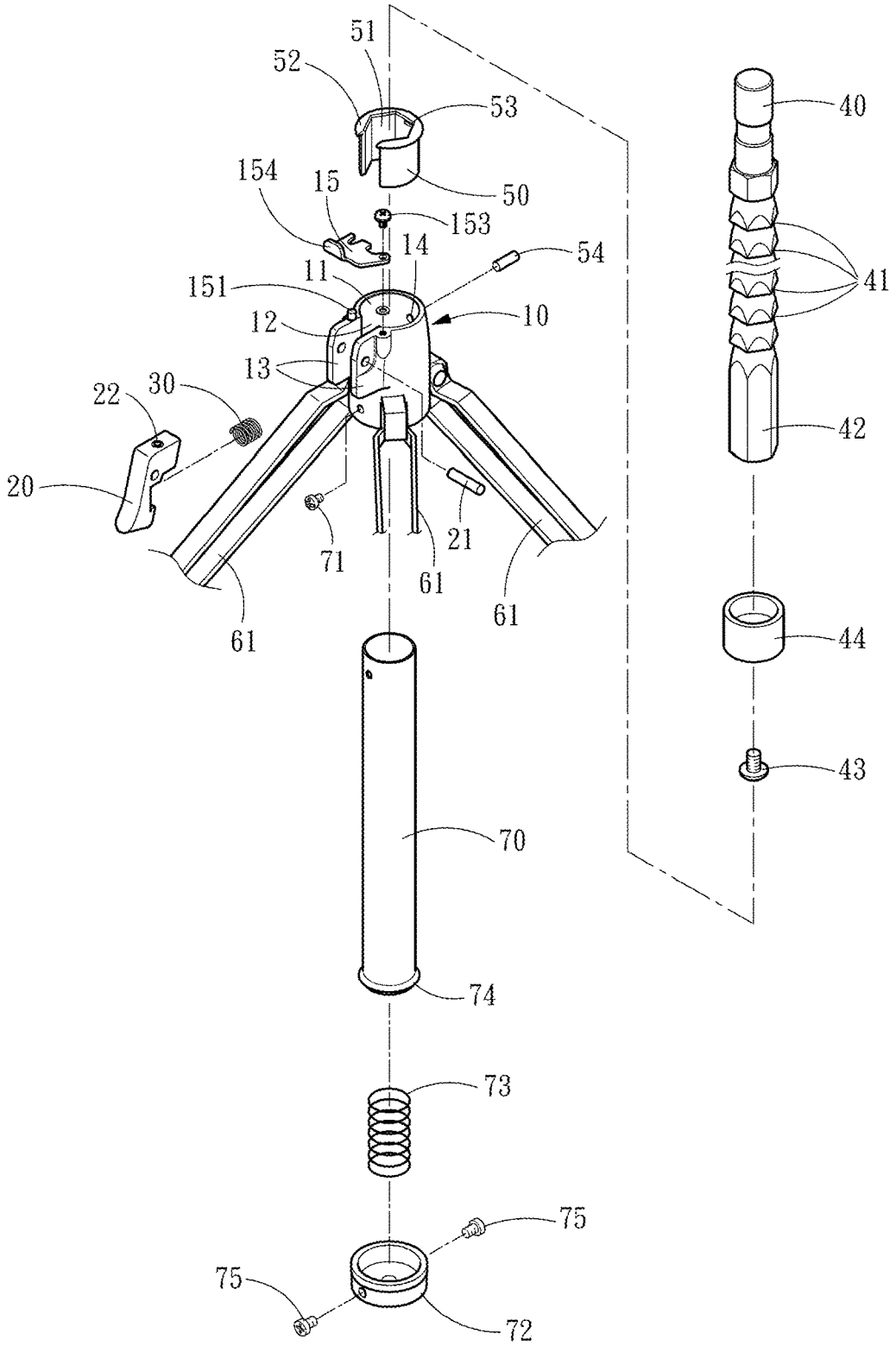
FIG. 6 is an exploded structural diagram of a local assembly installed and used for the present invention.
Figure 7:
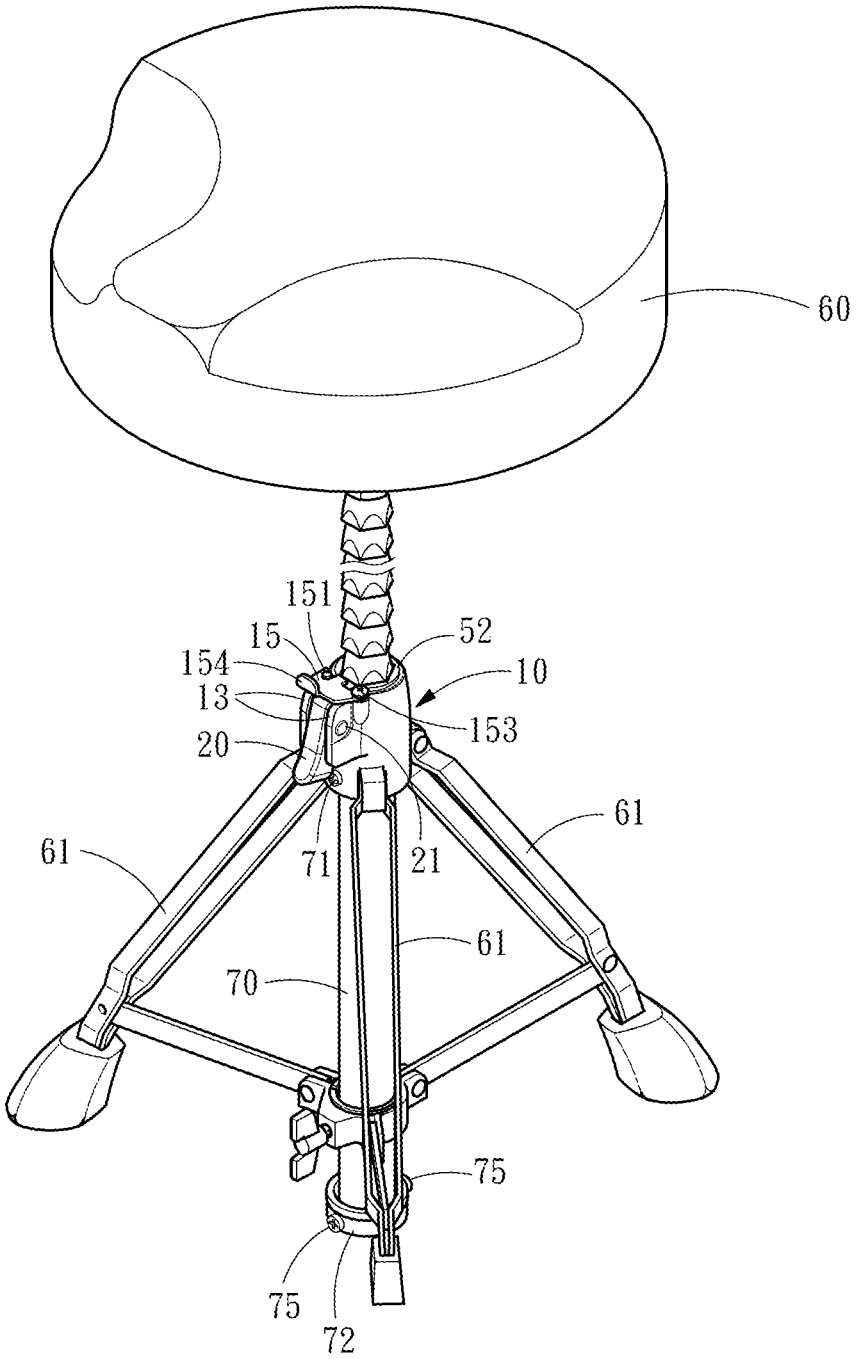
FIG. 7 is a structural diagram of a musical instrument chair installed in the present invention.

Referring to FIG. 6 and FIG. 7 together, the present invention can be used for adjusting the height of a musical instrument chair 60. An upper end of the upright rod 40 allows arrangement of the musical instrument chair 60, an upright tube 70 can be disposed below the upright rod seat 10, and a plurality of stands 61 can be pivoted to an adjacent side of the upright rod seat 10. The plurality of stands 61 and the upright tube 70 can be supported on the ground, so as to erect the upright rod seat 10. Therefore, the musical instrument chair 60 can allow sitting.

Moreover, the upright tube 70 further has a function of receiving and protecting the upright rod 40, the upright tube 70 and the upright rod seat 10 can be fixed by penetration of a fixing screw 71, a tube cover 72 can be disposed at the bottom of the upright tube 70 for sealing, and a buffer spring 73 can be put into the upright tube 70. The buffer spring 73 can support the upright rod 40, thereby preventing the upright rod 40 from being damaged due to a direct impact on the tube cover 72. In addition, a ring edge 74 can be provided on the outer side of the bottom of the upright tube 70. A fastening screw 75 fastened to the ring edge 74 is screwed to two sides of the tube cover 72 separately, so as to fix the tube cover 72. The bottom of the upright rod 40 can lock a round bushing 44 propping against the buffer spring 73 through a locking screw 43, and the round bushing 44 can further protect the upright rod 40 and prevent the upright rod 40 from directly penetrating into the buffer spring 73 due to a too-small aperture.

As above, the advantages of the present invention are at least as follows.

1. The user can execute an operation to change the height of the musical instrument chair by utilizing a manner of pressing the pressing plate, and the operation is quite labor-saving and rapid, and meets demands for use. 2. The upright rod comprises an unrounded axial profile, so that the upright rod can be avoided from rotation, and the stability of the musical instrument chair is increased. 3. By utilizing the design of upright tube-aided supporting on the ground, the stability and sitting weight of the musical instrument chair are increased, and the upright rod can be protected from damage. 4. Through the safe latch, the safety can be increased, thus avoiding a danger caused by maloperation of the pressing plate; meanwhile, the stability of an overall structure is increased.

What is claimed is:

1. A rapid fixing structure for a height adjusting rod of a musical instrument chair, used for adjusting a height of a musical instrument chair, comprising:

an upright rod seat, the upright rod seat being provided with an up-to-down through receiving space and a side opening horizontally communicated with the receiving space;

a pressing plate, the pressing plate being disposed at the side opening and pivoted to the upright rod seat, and possessing a normal position invading the receiving space and an instant position exiting from the receiving space;

a return spring, the return spring being disposed between the pressing plate and the upright rod seat, and pushing the pressing plate to be at the normal position under a normal state; and an upright rod, the musical instrument chair being disposed at an upper end of the upright rod, the upright rod penetrating into the receiving space from up to down, and being provided with a plurality of height-different fastening slots in which the pressing plate is fastened at the normal position so as to fix the upright rod, wherein two opposite side plates extend out from the side opening of the upright rod seat, and the pressing plate is pivoted to the two side plates through a pivot shaft.

2. The structure according to claim 1, wherein parts, in contact with the upright rod seat and the side opening, of the return spring are located on two sides of a pivot point between the pressing plate and the upright rod seat respectively, and a safe latch is pivoted to an adjacent side of the side opening of the upright rod seat, and the safe latch rotates with respect to the upright rod seat so as to possess a buckling position pressing the pressing plate to be at the normal position and a separating position separated from the pressing plate.

3. The structure according to claim 1, wherein the upright rod comprises an unrounded axial profile, and the receiving space is further provided with a C-shaped sleeve ring, and the C-shaped sleeve ring comprises an inner profile corresponding to the unrounded axial profile.

4. The structure according to claim 3, wherein the C-shaped sleeve ring is provided with a horizontal flange propping against an exterior of the upright rod seat.

5. The structure according to claim 3, wherein the C-shaped sleeve ring is provided with a sleeve ring locating hole, the upright rod seat is provided with a rod seat locating hole corresponding to the sleeve ring locating hole, and a plug pin penetrates through the sleeve ring locating hole and the rod seat locating hole at the same time.

6. The structure according to claim 3, wherein an upright tube is disposed below the upright rod seat, the upright tube receives and protects the upright rod, and the upright tube and the upright rod seat are fixed by penetration of a fixing screw.

7. The structure according to claim 6, wherein a tube cover is disposed at a bottom of the upright tube for sealing, and a buffer spring is put into the upright tube.

8. The structure according to claim 7, wherein a ring edge is provided on an outer side of the bottom of the upright tube, and a fastening screw fastened to the ring edge is screwed to two sides of the tube cover separately.

9. The structure according to claim 7, wherein a bottom of the upright rod locks a round bushing propping against the buffer spring through a locking screw.

* * * * *